US008875736B2

(12) United States Patent
Jeon

(10) Patent No.: US 8,875,736 B2
(45) Date of Patent: Nov. 4, 2014

(54) HYDRAULIC CONTROL VALVE FOR HEAVY EQUIPMENT

(75) Inventor: Man Suk Jeon, Kyungsangnam-do (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 1309 days.

(21) Appl. No.: 12/246,567

(22) Filed: Oct. 7, 2008

(65) Prior Publication Data

US 2009/0101854 A1 Apr. 23, 2009

(30) Foreign Application Priority Data

Oct. 22, 2007 (KR) ..... 10-2007-0106107

(51) Int. Cl.

*F15B 13/043* (2006.01)
*F15B 13/04* (2006.01)
*E02F 9/22* (2006.01)
*F15B 13/02* (2006.01)

(52) U.S. Cl.

CPC ..... *F15B 13/0403* (2013.01); *E02F 9/2271* (2013.01); *E02F 9/2267* (2013.01); *F15B 13/021* (2013.01)

USPC ..... 137/596.13; 137/596.18; 137/596.2; 91/436

(58) Field of Classification Search

CPC .. F15B 13/0403; F15B 13/021; E02F 9/2267; E02F 9/2271

USPC ..... 137/625.66, 625.68, 625.69, 625.6, 137/596.2, 596.18, 593.13; 91/436

See application file for complete search history.

(56) References Cited

U.S. PATENT DOCUMENTS 2,634,751 A * 4/1953 Borer ..... 137/625.66
5,862,831 A * 1/1999 Chung et al. ..... 137/596.2

(Continued)

FOREIGN PATENT DOCUMENTS

EP 1 647 719 A2 4/2006
GB 2 313 413 A 11/1997
JP 6-137304 A 5/1994

OTHER PUBLICATIONS

European Search Report dated Jun. 28, 2012 for European Patent Application No. 08018204.1-1252.

(Continued)

*Primary Examiner* — Craig Schneider
(74) *Attorney, Agent, or Firm* — Ladas & Parry LLP

(57) ABSTRACT

A hydraulic control valve for heavy equipment is provided, which includes a valve body having a supply passage supplied with a hydraulic fluid from a hydraulic pump, ports for supplying the hydraulic fluid to an actuator or receiving the hydraulic fluid from the actuator, tank passages for returning the hydraulic fluid from the actuator to a hydraulic tank, and a first regeneration passage for supplying a part of the returned hydraulic fluid to the supply passage; a spool slidably installed in the valve body in accordance with supply of a pilot signal pressure from an exterior, and controlling flow of the hydraulic fluid supplied to the actuator from the supply passage during shifting; and a regeneration valve installed between the first regeneration passage and the tank passage, and including a piston moved by the hydraulic fluid from the hydraulic pump, a regeneration spool shifted by pressure fluctuation of the supply passage to variably adjust a flow rate of the hydraulic fluid discharged from the first regeneration passage to the tank passage via a return passage, a first resilient member for resiliently supporting the regeneration spool in a direction opposite to a shifted direction of the regeneration spool, and a pilot piston for resiliently supporting a set pressure of the first resilient member.

5 Claims, 7 Drawing Sheets

(56) References Cited

U.S. PATENT DOCUMENTS

| | | | | |
|---|---|---|---|---|
| 7,131,368 | B2 * | 11/2006 | Jeon | 91/436 |
| 2003/0230082 | A1 | 12/2003 | Kim | |
| 2006/0081299 | A1 * | 4/2006 | Koo et al. | 137/625.69 |
| 2006/0207655 | A1 * | 9/2006 | Xiang et al. | 137/118.02 |

OTHER PUBLICATIONS

Espacenet English abstract of JP 6-137304 A.

* cited by examiner

HYDRAULIC CONTROL VALVE FOR HEAVY EQUIPMENT

CROSS-REFERENCE TO RELATED APPLICATION

This application is based on and claims priority from Korean Patent Application No. 10-2007-0106107, filed on Oct. 22, 2007 in the Korean Intellectual Property Office, the disclosure of which is incorporated herein in its entirety by reference.

BACKGROUND OF THE INVENTION

1. Field of the invention

The present invention relates to a hydraulic control valve with a regeneration function for heavy equipment such as an excavator, and more specifically, to a hydraulic control valve capable of maintaining the pressure in a regeneration passage, irrespective of changes in the discharge flow rate of a hydraulic pump, the location of a working device, working speed, a regeneration flow rate and a return flow rate.

2. Description of the Prior Art

In hydraulic circuits, a regeneration function supplies a hydraulic fluid which is returned to a hydraulic tank from a return side of an actuator (e.g. hydraulic cylinder), to a supply side flow path of the actuator by a regeneration valve, thereby ensuring working speed and thus improving the energy efficiency. In addition, it is possible to prevent a cavitation phenomenon from being generated due to short flow rate occurring at the supply side by increased driving speed of the actuator. Therefore, the regeneration function can prolong a lifespan of the respective components and reduce complaint of clients against the hydraulic circuit.

FIGS. 1 to 3 show the construction of a conventional hydraulic control valve for heavy equipment. The following will now describe the operation of the hydraulic control valve.

A hydraulic fluid discharged from a variable displacement hydraulic pump 1 is fed to a check valve C via a supply line 2, and thus the check valve C is pushed upward. As a result, the hydraulic fluid is fed to a supply passage 6 formed in the valve body 3. AS a pilot signal pressure Pi is fed from the exterior, a spool 7 is shifted to a left or right direction to supply the hydraulic fluid which is fed to the supply passage 6 to a first port 4 or a second port 5.

Since the first port 4 is connected to a large chamber 8*a* of a hydraulic cylinder 8 and the second port 5 is connected to a small chamber 8*b*, the hydraulic fluid is fed to the large chamber 8*a* from the supply passage 6 through the first port 4 when the spool 7 is shifted to a right direction. Thus, since the hydraulic cylinder 8 is extended, the hydraulic fluid discharged from the small chamber 8*b* passes through the second port 5, and is then returned to a hydraulic tank T.

If the spool 7 is shifted in a left direction, the hydraulic fluid is fed to the small chamber 8*b* from the hydraulic pump 1 via the supply passage 6 and the second port 5. The hydraulic fluid which is discharged from the large chamber 8*a* by the retraction of the hydraulic cylinder 8 passes through the first port 4, and is then returned to the hydraulic tank T.

In this instance, when the hydraulic cylinder is extended, a part of the hydraulic fluid discharged from the small chamber 8*b* is fed to the supply passage 6 by a regeneration valve 12, and thus a part of the hydraulic fluid returned to the hydraulic tank T is fed to the supply side of the hydraulic cylinder 8, thereby improving the energy efficiency. In addition, it is possible to prevent the cavitation phenomenon from being generated due to shortage of the hydraulic fluid fed to the hydraulic cylinder 8.

As shown in FIGS. 2 and 3, if the spool 7 is shifted in a right direction, that is, the hydraulic cylinder 8 is extended, the hydraulic fluid discharged from the small chamber 8*b* passes through the second port 5, and is thus fed to a tank passage 10*b* via the first regeneration passage 13, the passage 14 and the return passage 16 in order.

As a cross section of the return passage 16 is small to have a small diameter of a hole, the pressure is generated in the first regeneration passage 13. If the pressure is relatively higher than the pressure of the second regeneration passage 15 which is formed in the spool 7, the poppet 17 formed in the spool 7 is moved in a right direction, and thus the hydraulic fluid is fed to the supply passage 6 from the first regeneration passage 13 via the second regeneration passage 15. That is, a part of the hydraulic fluid to be returned to the hydraulic tank T is supplementarily supplied to the supply side.

Meanwhile, in case where strong force is required for operation of the hydraulic cylinder 8, that is, a heavy load is produced, the hydraulic cylinder 8 generates strong force, as the pressure of the first port 4 is under the same condition and back pressure of the second port 5 is weak (i.e. back pressure of the first regeneration passage 13 is weak).

More specifically, if the pressure of the supply passage 6 is above a set value, as shown in FIG. 3, a regeneration spool 22 is moved in a right direction by a piston 21 urged by the pressure of the supply passage 6. As a result, as an opening rate of the return passage 16 is gradually increased, that is, a passing area of the hydraulic fluid is changed, the back pressure of the first regeneration passage 13 is decreased, so that the hydraulic cylinder 8 produces the strong force.

The regeneration spool 22 varying the opening rate of the return passage 16 is resiliently supported by a first resilient member 23 (e.g helical compressive spring), and the piston 21 moved by the pressure of the supply passage 6 comes in close contact with the front of the regeneration spool 22.

If the pressure of the supply passage 6 is increased more than the set pressure, the piston 21 is urged in a right direction, and thus the regeneration spool 22 is also moved in a right direction. Therefore, since the opening rate of the return passage 16 is gradually increased, the pressure of the first regeneration passage 13 is decreased, so that the hydraulic cylinder 8 produces the strong force.

The change of pressure in the first regeneration passage 13, the flow rate passing through the first regeneration passage 13 and the tank passage 10*b*, and the area of the return passage 16 satisfy the following equation:

$$\Delta P = C \times (Q/A)^2$$

ΔP is the change of pressure in the first regeneration passage 13;

C is flow coefficient;

Q is a flow rate moved from the first regeneration passage 13 to the tank passage 10*b;* and A is a variable area of the return passage 16.

Here, the flow rate Q may be varied depending upon the supply flow rate of the hydraulic pump 1, the position of the working devices, and the flow rate regenerated through the second regeneration passage 15.

The pressure of the first regeneration passage 13 is varied in accordance with the change of the flow rate Q and the area A, and the pressure of the supply passage 6 is varied in line with the fluctuation of the regeneration passage. Thus, the regeneration spool 22 urged by the first resilient member 23 is moved by the regeneration spool 22.

The fluctuation of the pressures in the first and second ports 4 and 5 causes the hydraulic cylinder 8 to unnaturally drive, that is, hunting happens due to irregular drive. Therefore, it is difficult to control the driving of the hydraulic cylinder 8.

As shown in FIG. 3, in case where the regeneration valve 12 is assembled to or disassembled from the valve body 3, it is not possible to assemble or disassemble the valve body 3 engaged with the regeneration valve 12.

In case where the valve body 3 engaged with the regeneration valve 12 in a separation type is disassembled, the disassembling workability is lowered since some parts of the regeneration valve 12 are held in the engaged portion of the valve body 3.

Besides, if a component is dropped through carelessness at disassembly of the regeneration valve 12, the component is lost, or the component is contaminated by dirt or soil. The contamination of the component causes additional washing to be performed on the component, thereby lowering the work efficiency.

As shown in FIG. 3, according to the application of inner drain manner in which the hydraulic fluid is drained from a back-pressure chamber 24 through a drain hole 12*a*, there is a problem in that the fluctuation of the back pressure causes the hunting, since the back pressure of the hydraulic tank is directly connected in the equipment.

SUMMARY OF THE INVENTION

Accordingly, the present invention has been made to solve the above-mentioned problems occurring in the prior art while advantages achieved by the prior art are maintained intact.

One object of the present invention is to provide a hydraulic control valve with a regeneration function, capable of constantly maintaining the pressure in a regeneration passage, irrespective of changes in a discharge flow rate of a hydraulic pump, a position of a working device, a regeneration flow rate and a return flow rate.

The embodiment of the present invention is related to a hydraulic control valve for heavy equipment which can prevent fluctuation of back pressure in accordance with the change of the flow rate drained by operation of a working device.

The embodiment of the present invention is related to a hydraulic control valve for heavy equipment which can improve the working efficiency by assembling or disassembling the hydraulic control valve engaged with a regeneration valve.

In order to accomplish these objects, there is provided a hydraulic control valve for heavy equipment, according to embodiments of the present invention, which includes a valve body including a supply passage supplied with a hydraulic fluid from a hydraulic pump, ports for supplying the hydraulic fluid to an actuator from the supply passage or receiving the hydraulic fluid from the actuator, tank passages for returning the hydraulic fluid discharged from the actuator to a hydraulic tank, and a first regeneration passage for supplying a part of the hydraulic fluid returned from the actuator to the supply passage; a spool slidably installed in the valve body in accordance with supply of a pilot signal pressure from an exterior, and controlling flow of the hydraulic fluid supplied to the actuator from the supply passage during shifting, the spool having a second regeneration passage, formed therein, for supplying the hydraulic fluid from the first regeneration passage to the supply passage; and a regeneration valve installed between the first regeneration passage and the tank passage, and including a piston moved by the hydraulic fluid from the hydraulic pump, a regeneration spool shifted by pressure fluctuation of the supply passage to variably adjust a flow rate of the hydraulic fluid discharged from the first regeneration passage to the tank passage via a return passage, a first resilient member for resiliently supporting the regeneration spool in a direction opposite to a shifted direction of the regeneration spool to increase an opening rate of the return passage, and a pilot piston for resiliently supporting a set pressure of the first resilient member.

According to a preferred embodiment of the present invention, the regeneration spool includes a recessed portion, formed on a portion of an outer periphery of the regeneration spool, for preventing a flow force due to a flow rate generated during the shifting of the regeneration spool, the portion of the outer periphery varying an opening rate of the return passage which communicates with the tank passage.

The hydraulic control valve further includes a stopper engaged with the pilot piston for controlling stroke of the regeneration spool in such a way that the stopper is opposite to one end of the regeneration spool.

The hydraulic control valve further includes an O-ring mounted on an outer periphery of the regeneration spool for preventing a back pressure from being increased due to leakage of the hydraulic fluid from the first regeneration chamber to the back pressure chamber during the shifting of the regeneration spool.

The set pressure of the first resilient member is variably adjusted by supplying a signal pressure to the pilot piston from an exterior.

The hydraulic control valve further includes a pilot valve having a first state where the signal pressure supplied to the pilot piston from an exterior is interrupted, and a second state where the signal pressure is supplied to the pilot piston from the exterior by the supply of a signal pressure during the shifting of the regeneration spool.

The hydraulic control valve further includes an O-ring for leakage prevention mounted on an outer surface of a sleeve, to which the regeneration spool is shiftably engaged, in order to prevent the hydraulic fluid from being leaked from the supply passage to the back pressure chamber.

The hydraulic control valve further includes an external drain port formed on the sleeve to communicate with the back pressure chamber.

With the above description, the pressure can be constantly maintained in a regeneration passage to prevent hunting of an actuator, irrespective of changes in the discharge flow rate of the hydraulic pump, the position of a working device, the regeneration flow rate and the return flow rate.

The hydraulic control valve can improve the working efficiency by assembling or disassembling the hydraulic control valve engaged with a regeneration valve.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
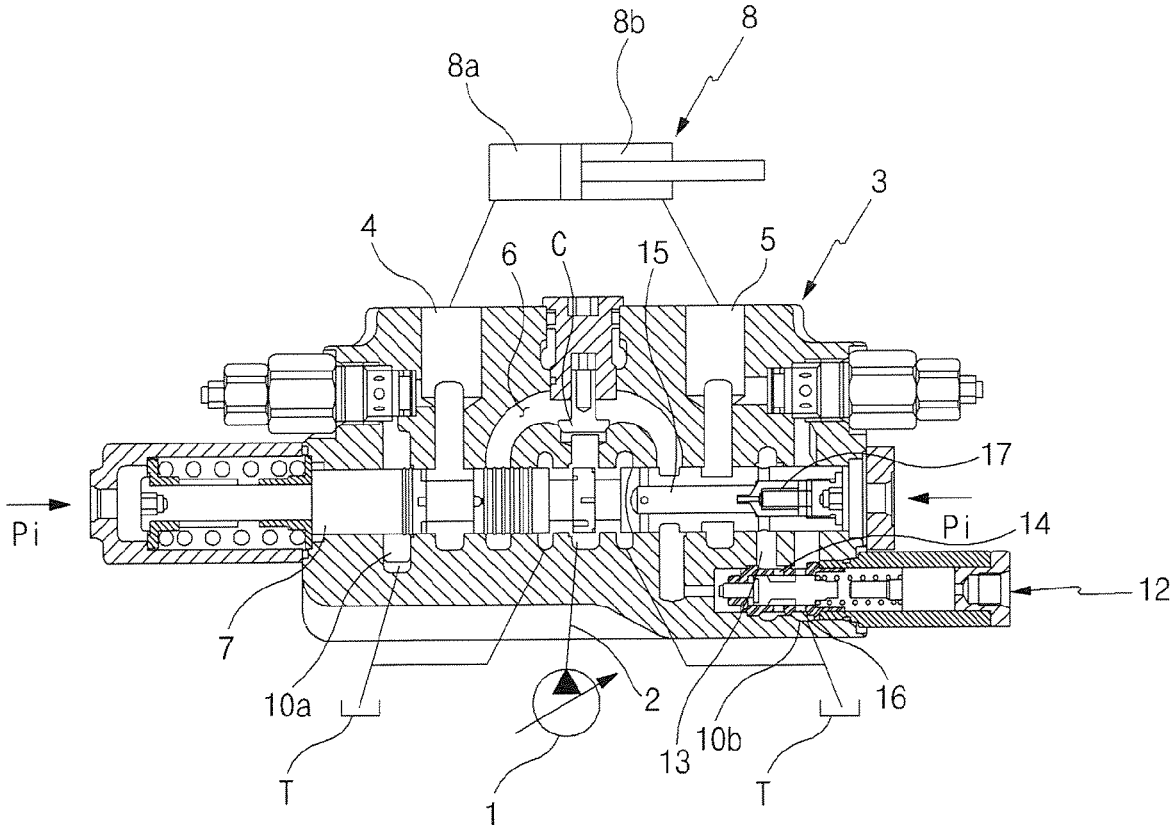
Fig. 1 Prior Art
FIG. 1 is a cross-sectional view of a related art hydraulic control valve.

Hereinafter, preferred embodiments of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto.

FIGS. 4 to 10 show of a hydraulic control valve for heavy construction equipment according to one embodiment of the present invention.

The hydraulic control valve according to the present invention includes a valve body 3 having a supply passage 6 to which a hydraulic fluid discharged from a hydraulic pump 1 is supplied, a first port 4 and a second port 5 for supplying the hydraulic fluid in the supply passage 6 to an actuator 8 (e.g. a hydraulic cylinder) or receiving the hydraulic fluid from the actuator 8, tank passages 10*a* and 10*b* for returning the hydraulic fluid discharged from the actuator 8 to a hydraulic tank T, and a first regeneration passage 13 for supplying a part of the hydraulic fluid returned from the actuator 8 to the supply passage 6 to regenerate the hydraulic fluid.

Also, the hydraulic control valve includes a spool 7 which is slidably installed in the valve body 3 in accordance with supply of a pilot signal pressure Pi from an exterior, and controls the flow of the hydraulic fluid supplied to the actuator 8 from the supply passage 6 at shift of the spool, in which a second regeneration passage 15 for supplying the hydraulic fluid to the supply passage 6 from the first regeneration passage 13 is formed in the spool 7.

Also, the hydraulic control valve includes a regeneration valve 12 which is installed between the first regeneration passage 13 and the tank passage 10*b*, and has a piston 21 moved by the hydraulic fluid from the hydraulic pump 1, a regeneration spool 22 shifted by pressure fluctuation of the supply passage 16 to variably adjust a flow rate of the hydraulic fluid discharged to the tank passage 10*b* from the first regeneration passage 13 via the return passage 16, a first resilient member 23 (e.g. helical compressive spring) for resiliently supporting the regeneration spool 22 in a direction opposite to a shifted direction of the regeneration spool 22 to increase an opening rate of the return passage 16, and a pilot piston 25 for resiliently supporting the set pressure of the first resilient member 23.

The regeneration spool 22 includes a recessed portion 22*a*, formed on an outer periphery of the regeneration spool 22, for preventing flow force due to a flow rate generated during the shifting of the regeneration spool 22, the outer periphery varying an opening rate of the return passage 16 which communicates with the tank passage 10*b*.

A stopper 26 is engaged to the pilot piston 25 to control stroke of the regeneration spool 22 in such a way that the stopper is opposite to one end of the regeneration spool 22.

An O-ring 27 is mounted on the outer periphery of the regeneration spool 22 to prevent a back pressure from being increased due to leakage of the hydraulic fluid from the first regeneration chamber 13 to the back pressure chamber 24 during the shifting of the regeneration spool 22.

The set pressure of the first resilient member 23 is variably adjusted by supplying the signal pressure Px to the pilot piston 25 from an exterior.

The regeneration spool 22 further includes a pilot valve 28 having a first state where the signal pressure Px supplied to the pilot piston 25 from the exterior is interrupted, and a second state where the signal pressure Px is supplied to the pilot piston 25 from the exterior by the supply of a signal pressure Py during the shifting of the regeneration spool.

An O-ring 30 for leakage prevention is mounted on an outer surface of a sleeve 29, to which the regeneration spool 22 is shiftably engaged, in order to prevent the hydraulic fluid from being leaked from the supply passage 6 to the back pressure chamber.

An external drain port 31 is formed on the sleeve 29 to communicate with the back pressure chamber 24.

Figure 2:
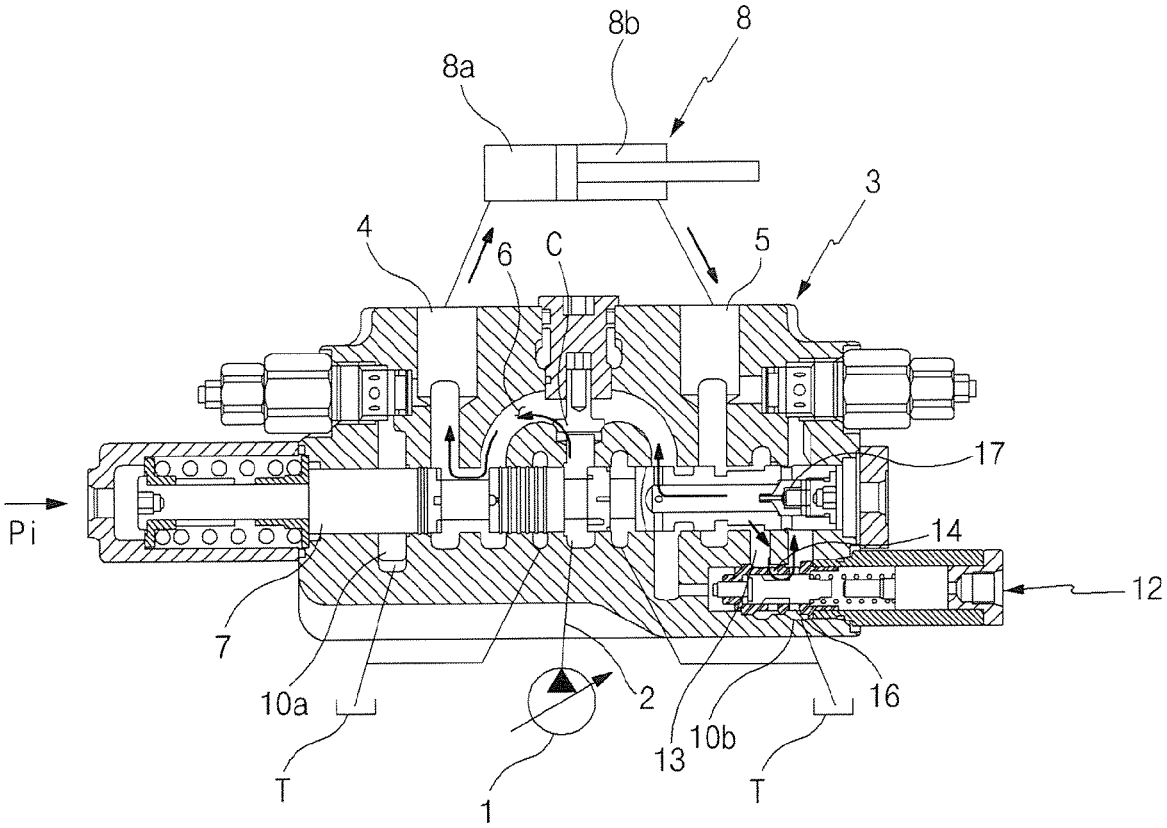
Fig. 2 Prior Art
FIG. 2 is a cross-sectional view illustrating the operation of the hydraulic control valve in FIG. 1.
Figure 3:
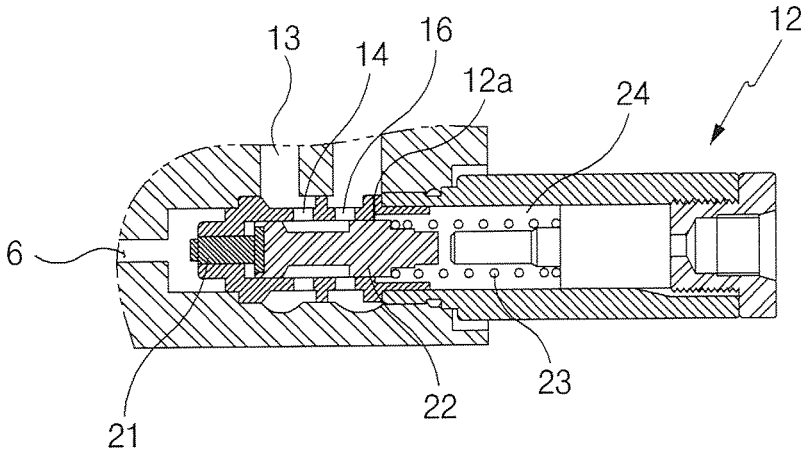
Fig. 3 Prior Art
FIG. 3 is a partial cross-sectional view of the hydraulic control valve in FIG. 1.
Figure 4:
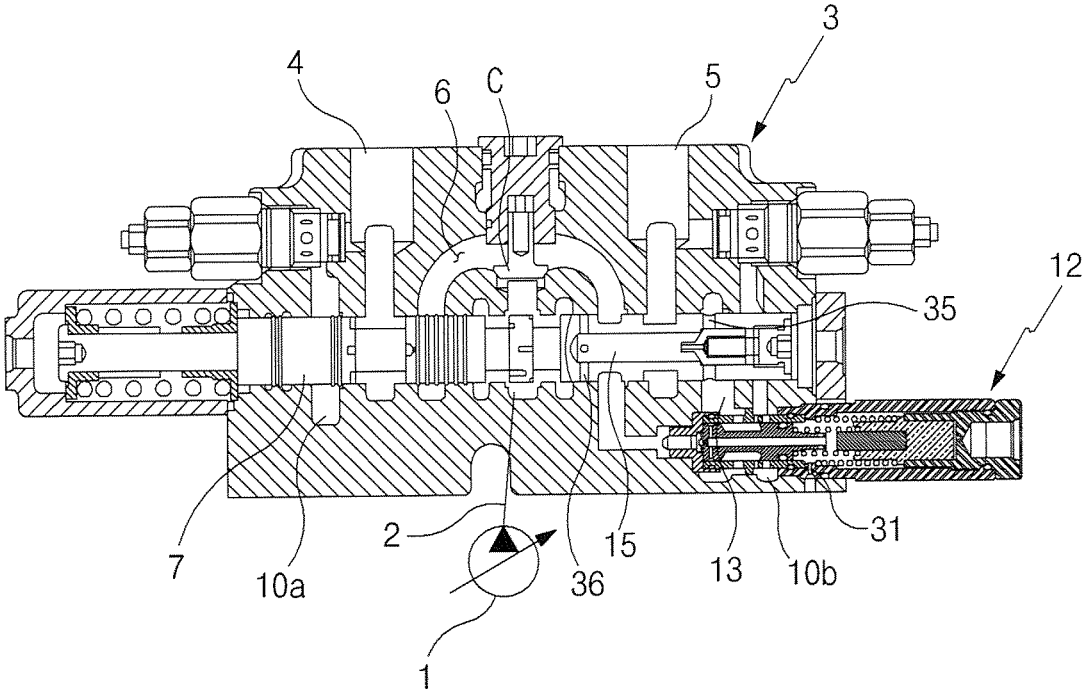
FIG. 4 is a cross-sectional view of a hydraulic control valve for heavy construction equipment according to one embodiment of the present invention.

The construction comprising the actuator 8 connected to the variable displacement hydraulic pump 1, the supply line 2, the first and second ports 4 and 5, the valve body 3 with the supply passage 6, the spool 7 coupled to the valve body 3 for controlling the flow of the hydraulic fluid fed to the actuator 8 during the shifting, the regeneration valve 12 for supplying the hydraulic fluid discharged from the actuator 8 to the supply passage 6, the second regeneration passage 15 formed in the spool 7, and the piston 21 for pressing the regeneration spool 22 in accordance with the pressure of the supply passage 6 is substantially similar to that of the conventional hydraulic control valve shown in FIGS. 1 to 3, and thus the detailed description thereof will be omitted herein, in which the same components are denoted by the same reference numerals.

Reference numeral 17 denotes a poppet valve which is installed on one end of the second regeneration passage 15 to open and close the poppet valve, the poppet valve being opened to supply the hydraulic fluid to the supply passage 6 from the first regeneration passage 13 via the second regeneration passage 15, when the pressure of the first regeneration passage 13 is higher than that of the second regeneration passage 15.

The operation of the hydraulic control valve for the heavy equipment according to an embodiment of the present invention will now be described in detail with reference to the drawings.

A) It will now be described the case where a part of the hydraulic fluid returned from a small chamber of the hydraulic cylinder to the hydraulic tank is fed to the supply passage which is connected to a large chamber, to regenerate the returned hydraulic fluid (i.e. the pressure of the second port 5 communicating with the small chamber 8*b* of the hydraulic cylinder 8 is relatively higher than the pressure of the first port 4 communicating with the large chamber 8*a*).

Figure 5:
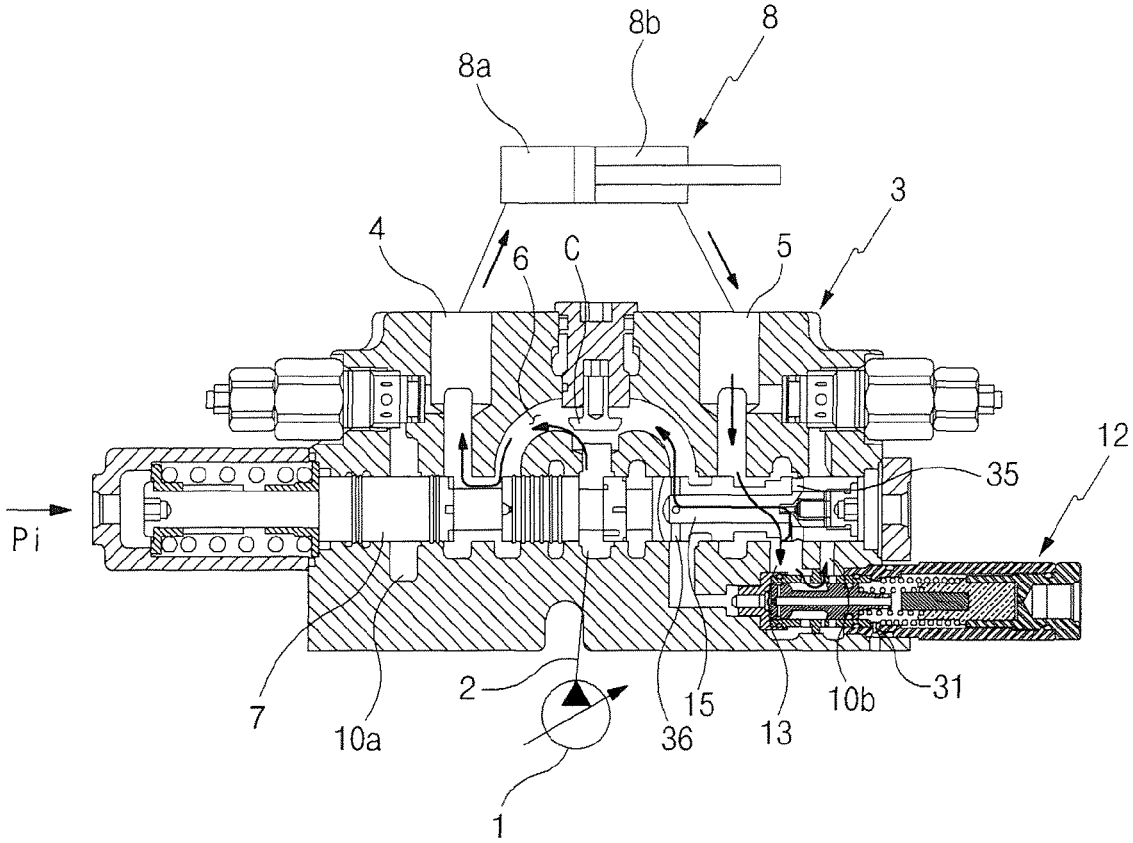
FIG. 5 is a cross-sectional view illustrating the first operation of the hydraulic control valve in FIG. 4.

As shown in FIG. 5, if the spool 7 is shifted in a right direction by the pilot signal pressure Pi supplied from the exterior, the hydraulic fluid discharged from the hydraulic pump 1 via the supply line 2 pushes the check valve c upward, and is thus fed to the supply passage 6.

More specifically, the hydraulic fluid in the supply passage 6 is fed to the large chamber 8*a* of the hydraulic cylinder 8 via the first port 4 to extend the hydraulic cylinder 8. In this instance, the hydraulic fluid discharged from the small chamber 8*b* passes through the second port 5 and the notch of the spool 7, and is then fed to the first regeneration passage 13.

If the pressure of the second port 5 communicating with the small chamber 8*b* is relatively higher than the pressure of the first port 4, the hydraulic fluid fed to the first regeneration passage 13 from the second port 5 is divided into two parts (moving directions of the hydraulic fluid are indicated by arrows).

Since the return passage 16 is closed by the regeneration spool 22 at an initial stage, the pressure is generated in the first regeneration passage 13. If the pressure of the first regeneration passage 13 (i.e. the pressure of the hydraulic cylinder 8) is relatively higher than the pressure of the second regeneration passage 15 (i.e. the pressure of the hydraulic pump 1), the poppet 17 installed in the second regeneration passage 15 is moved in a right direction.

More specifically, as a part of the hydraulic fluid fed to the first regeneration passage 13 passes through a regeneration hole 35 to move the poppet 17 in a right direction, the hydraulic fluid in the first regeneration passage 13 passes through the second regeneration passage 15 and the regeneration hole 35, and is then fed to the supply passage 16 and the first port 4 to regenerate the hydraulic fluid.

The remaining part of the hydraulic fluid fed to the first regeneration passage 13 is fed to the tank passage 10*b* via the passages 14 and 19 formed in the sleeve 29, and is then drained to the hydraulic tank T. In this instance, if the regeneration spool 22 is shifted in a right direction, the hydraulic fluid passing through the passage 14 is fed to the tank passage 10*b* via the return passage 16, the return passage 16 having an opening area relatively larger than that of the passage 19.

The hydraulic fluid discharged from the small chamber 8*b* of the hydraulic cylinder 8 and then supplied to the first regeneration passage 13 is fed to the tank passage 10*b* via the passages 14 and 19, and simultaneously is fed to the tank passage 10*b* via the passage 14 and the return passage 16.

If the hydraulic fluid in the first regeneration passage 13 is fed to the passage 14, the return passage 16 and the tank passage 10*b*, the pressure of the passage 37 fed with the hydraulic fluid from the hydraulic pump 1 is also raised. The piston 21 is urged in a right direction by the pressure of the passage 37 to move the regeneration spool 22 in a right direction. In this instance, if the regeneration spool 22 is shifted in a right direction, the hydraulic fluid early passing through the passage 19 is also fed to the return passage 16, and is then drained to the tank passage 10*b*.

If the pressure is raised in the back pressure chamber 24 due to the leakage during the shifting of the regeneration spool 22, the hydraulic fluid is drained outwardly through the external drain port 31 formed on the sleeve 29. As a result, it is possible to prevent the fluctuation of the back pressure even though a flow rate of the returned hydraulic fluid is changed when the working device is driven.

In case of shifting the regeneration spool 22, it is possible to prevent the back pressure from being raised in the back pressure chamber due to leakage of the hydraulic fluid through a gap resulted by a difference between an outer diameter of the regeneration spool 22 and an inner diameter of the sleeve 29, by using the O-ring 30 mounted on the outer periphery of the sleeve 29 and the O-ring 27 mounted on the outer periphery of the regeneration spool 22. Also, it is possible to prevent chattering of the regeneration spool 22 by using the O-ring 27.

The flow rate passing through the return passage 16 is delayed by the recessed portion 22*a* formed on the outer periphery of the regeneration spool 22 at a certain angle which varies an opening rate of the return passage 16 communicating with the tank passage 10*b*, thereby preventing the flow force of the flow rate from being generated when the regeneration spool 22 is shifted.

B) It will now be described the case of not generating a part of the hydraulic fluid returned to the hydraulic tank from a small chamber of the hydraulic cylinder (i.e. the pressure of the first port 1 communicating with the small chamber 8*b* of the hydraulic cylinder 8 is relatively higher than the pressure of the second port 5 communicating with the small chamber 8*b*).

Figure 6:
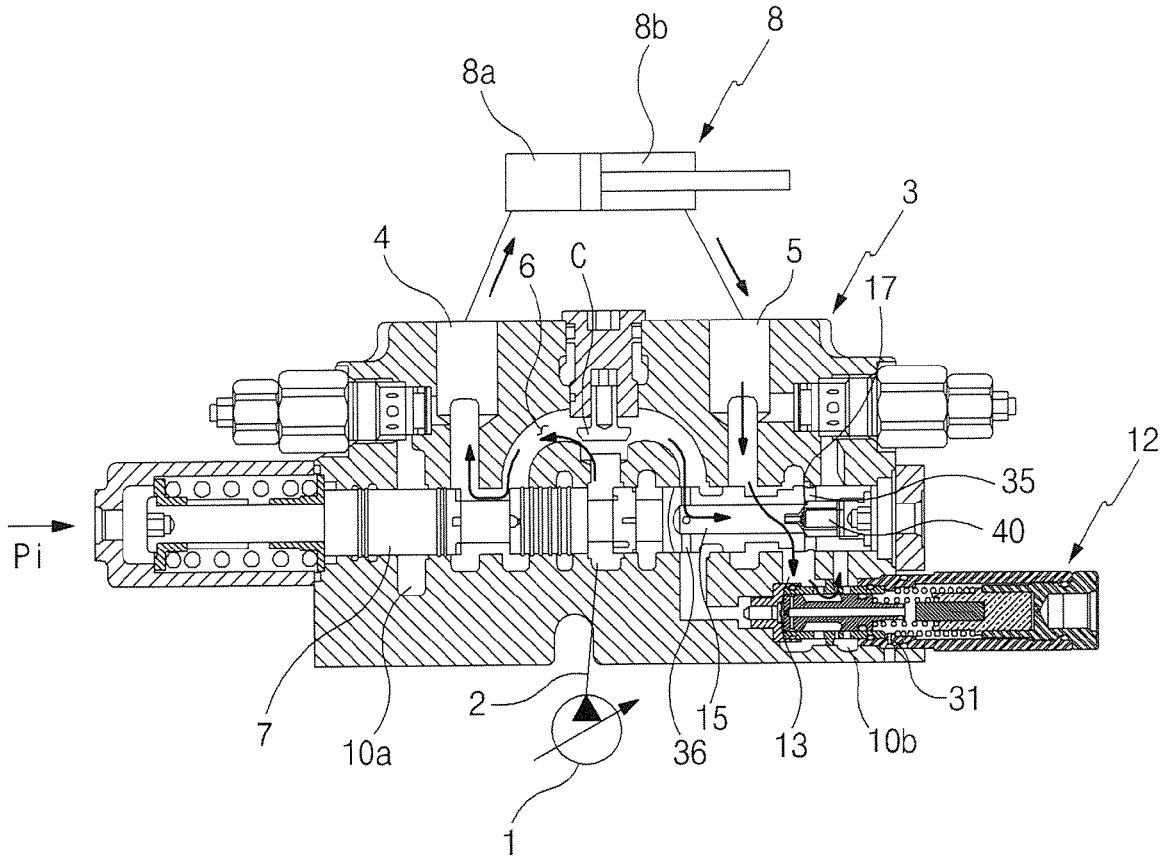
FIG. 6 is a cross-sectional view illustrating the second operation of the hydraulic control valve in FIG. 4.
Figure 7:
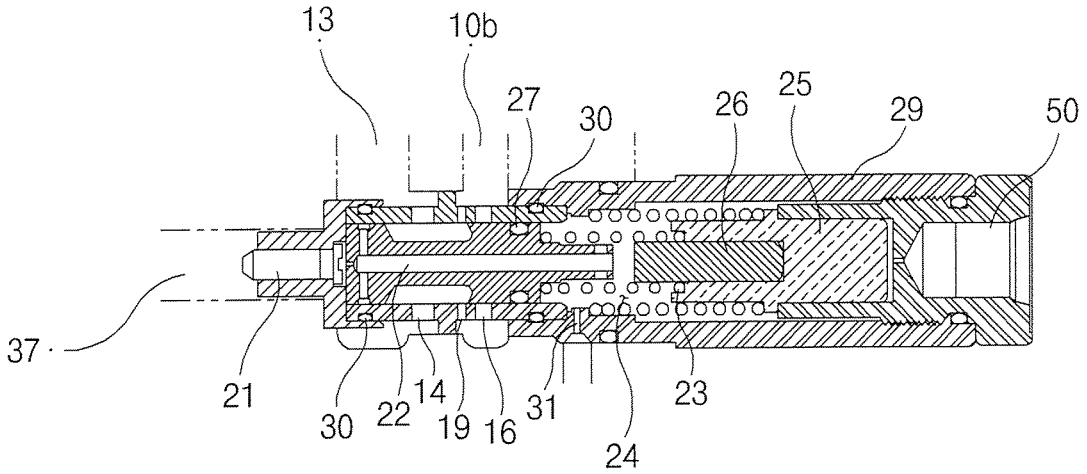
FIG. 7 is a partial cross-sectional view of the hydraulic control valve in FIG. 4.

As shown in FIG. 6, if the spool 7 is shifted in a right direction by the pilot signal pressure Pi supplied from the exterior, the hydraulic fluid discharged from the hydraulic pump 1 via the supply line 2 pushes the check valve c upward, and is thus fed to the supply passage 6.

That is, a part of the hydraulic fluid in the supply passage 6 is fed to the large chamber 8*a* of the hydraulic cylinder 8 via the first port 4 to extend the hydraulic cylinder 8. In this instance, the hydraulic fluid discharged from the small chamber 8*b* passes through the second port 5 and the notch of the spool 7, and is then fed to the first regeneration passage 13.

The remaining part of the hydraulic fluid in the supply passage 6 is fed to the second regeneration spool 15 via the regeneration hole 36. In this instance, since the pressure of the first port 4 is relatively higher than that of the second port 5, the poppet 17 is not opened by the pressure of the hydraulic fluid fed to the second regeneration spool 15.

That is, the following equation will be given:

[Pressure of the second port 5 (i.e. Pressure acting to open poppet 17)]×[Cross section (i.e. Cross section of seat of poppet 17)]<[Pressure of the first port 4 (i.e. Pressure to be generated in chamber 40 to close poppet 17)]×[Cross section of outer diameter portion of poppet 17]

Consequently, in case where the hydraulic fluid returned from the small chamber 8*b* is fed to the first regeneration passage 13 via the second port 5, the poppet 17 is maintained in a closed state. The first regeneration flow path 13 and the second regeneration flow path 15 are closed not to perform the regeneration function.

A part of the hydraulic fluid passing through the regeneration hole 36 from the supply passage 6 is fed to the passage 37 to urge the piston 21 in a right direction, that is, the pressure of the hydraulic fluid in the passage 37 exceeds the resilient force of the first resilient member 23 by the pressure formed in the supply passage 6.

As the regeneration spool 22 is shifted in a right direction by the piston 21, the hydraulic fluid fed to the first regeneration passage 13 is fed to the tank passage 10*b* via the passage 14, the passage 19 and the return passage 16.

If the regeneration spool 22 is moved in a right direction, the hydraulic fluid is drained to the hydraulic tank T from the back pressure chamber 24 via the port 31. When the regeneration spool 22 is shifted, the stroke of the regeneration spool 22 is controlled by the stopper 26 engaged to the pilot piston 25.

That is, the hydraulic fluid discharged from the small chamber 8*b* of the hydraulic cylinder 8 is returned to the hydraulic tank T via the second port 5, the notch of the spool 7, the first regeneration passage 13 and the tank passage 10*b*.

In the operation of the working device such as a boom by expansion and contraction of the hydraulic cylinder 8, in case where combined operation is performed in view of the working efficiency, the pressure of the supply side of the hydraulic pump is forcibly raised to perform the work requiring the heavy load.

Figure 8:
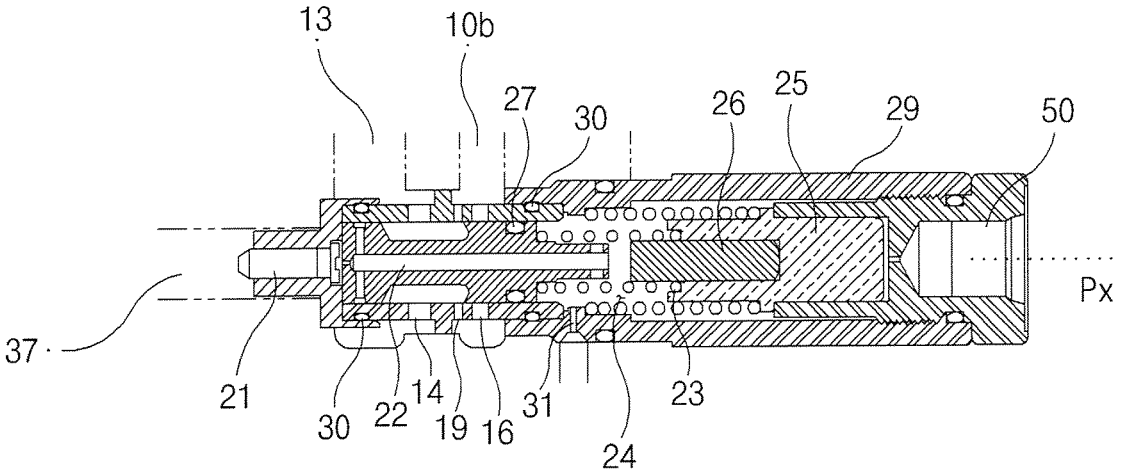
FIG. 8 is a cross-sectional view illustrating the supply of a signal pressure to vary a set pressure of the regeneration valve in FIG. 4 according to one embodiment of the present invention.

As shown in FIG. 8, if a pilot signal pressure Px is fed to a signal inlet 50 from the exterior, the pilot piston 25 is urged in a left direction to vary the resilient force of the first resilient member 23 and the set pressure of the regeneration pressure 22.

As the pressure (back pressure) is raised in the first regeneration passage 13 by the supply of the pilot signal pressure Px from the exterior, the pressure is raised in the supply passage 6. Therefore, it is possible to perform a combined operation with other working devices which generate heavy load.

Figure 9:
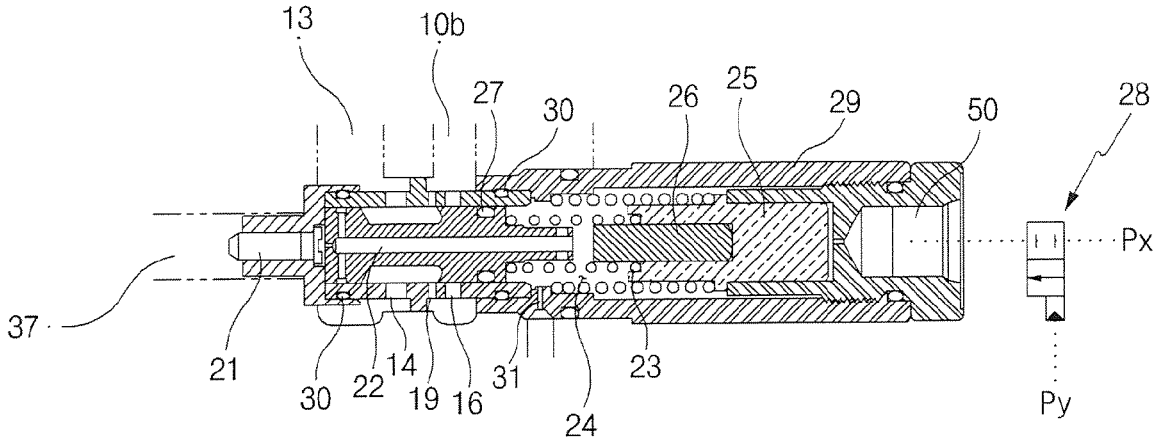
FIG. 9 is a cross-sectional view illustrating the supply of a signal pressure to vary a set pressure of the regeneration valve in FIG. 4 according to another embodiment of the present invention.
Figure 10:
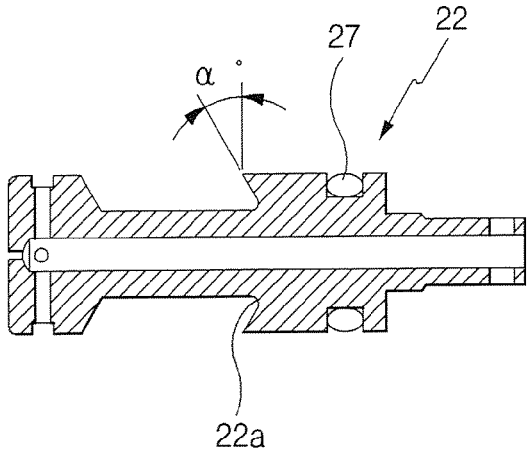
FIG. 10 is a cross-sectional view of the regeneration spool in FIG. 4.

As shown in FIG. 9, if a pilot signal pressure Py is fed to the pilot valve 28, the spool maintained in a neutral position in the pilot valve 28 is shifted upward, the signal pressure Px is fed to the signal inlet 50 from the exterior, thereby varying the set pressure of the regeneration spool 22 which is identical to that in FIG. 8.

In case of manipulating other working devices requiring no heavy load according to working conditions (In FIG. 9, the pilot valve 28 is shown in a neutral position), the pressure of the supply passage 6 is maintained at the early set level. It is possible to raise the pressure of the supply passage 6 above the set pressure when performing a combined operation with other working devices requiring heavy load.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A hydraulic control valve for heavy equipment, comprising:

a valve body including a supply passage supplied with a hydraulic fluid from a hydraulic pump, ports for supplying the hydraulic fluid to an actuator from the supply passage or receiving the hydraulic fluid from the actuator, tank passages for returning the hydraulic fluid discharged from the actuator to a hydraulic tank, and a first regeneration passage for supplying a part of the hydraulic fluid returned from the actuator to the supply passage;

a spool slidably installed in the valve body in accordance with supply of a pilot signal pressure from an exterior, and controlling flow of the hydraulic fluid supplied to the actuator from the supply passage during shifting, the spool having a second regeneration passage, formed therein, for supplying the hydraulic fluid from the first regeneration passage to the supply passage;

a regeneration valve installed between the first regeneration passage and the tank passage, and including a piston moved by the hydraulic fluid from the hydraulic pump, a regeneration spool shifted by pressure fluctuation of the supply passage to variably adjust a flow rate of the hydraulic fluid discharged from the first regeneration passage to the tank passage via a return passage, a first resilient member for resiliently supporting the regeneration spool in a direction opposite to a shifted direction of the regeneration spool to increase an opening rate of the return passage, and a pilot piston for resiliently supporting a set pressure of the first resilient member;

a stopper engaged with the pilot piston for controlling stroke of the regeneration spool such that the stopper is opposite to one end of the regeneration spool;

an O ring mounted on an outer periphery of the regeneration spool for preventing a back pressure from being increased due to leakage of the hydraulic fluid from the first regeneration chamber to the back pressure chamber during the shifting of the regeneration spool;

a pilot valve having a first state where the signal pressure supplied to the pilot piston from an exterior is interrupted, and a second state where the signal pressure is supplied to the pilot piston from the exterior by the supply of a signal pressure during the shifting of the regeneration spool;

wherein the regeneration spool comprises a back pressure chamber, a sleeve and an external drain port formed on the sleeve that communicates with the back pressure chamber; and wherein the regeneration spool includes means, formed on a portion of an outer periphery of the regeneration spool, for preventing a flow force due to a flow rate generated during the shifting of the regeneration spool and for varying an opening rate of the return passage which communicates with the tank passage.

2. The hydraulic control valve of claim 1, wherein the set pressure of the first resilient member is variably adjusted by supplying a signal pressure to the pilot piston from an exterior.

3. The hydraulic control valve of claim 1, further comprising an O ring for leakage prevention mounted on an outer surface of the sleeve, to which the regeneration spool is shiftably engaged, in order to prevent the hydraulic fluid from being leaked from the supply passage to the back pressure chamber.

4. The hydraulic control valve of claim 1, wherein the stopper extends beyond an end of the pilot piston whereby the stopper can stop the regeneration spool before the regeneration spool contacts the end of the pilot piston.

5. The hydraulic control valve of claim 1, wherein the means for preventing comprises a recess formed along a portion of the outer periphery, wherein the recess is elongate in cross section and forms an acute angle in the regeneration spool at an end of the recess that is closest to the first resilient member.

* * * * *